United States Patent [19]

Waibel

[11] Patent Number: 4,874,265

[45] Date of Patent: Oct. 17, 1989

[54] IMPACT MECHANISM FOR IMPACT PRINTER

[75] Inventor: Helmut K. Waibel, Fremont, Calif.

[73] Assignee: Xerox Corporation, Stamford, Conn.

[21] Appl. No.: 206,555

[22] Filed: Jun. 14, 1988

[51] Int. Cl.[4] ..... B41J 9/04

[52] U.S. Cl. ..... 400/357; 400/144.2; 400/157.2; 400/166; 400/385; 400/389; 400/388.1; 101/93.19; 101/93.29; 101/93.48

[58] Field of Search ..... 400/59, 63, 144.2, 144.3, 400/94, 248, 174, 175, 356, 354.3, 157.1, 157.2, 370, 375.3, 376, 357, 166, 385, 389, 388.1; 101/93.48, 93.15, 93.16, 93.17, 93.31, 93.19, 93.29

[56] References Cited

U.S. PATENT DOCUMENTS

| | | | |
|---|---|---|---|
| 4,023,662 | 5/1977 | Perurea | 400/59 X |
| 4,086,997 | 5/1978 | Wu | 400/59 X |
| 4,652,153 | 3/1987 | Kotsuzumi et al. | 400/59 X |
| 4,657,415 | 4/1987 | Khushi et al. | 400/59 |
| 4,668,112 | 5/1987 | Guba et al. | 400/144.2 X |
| 4,678,355 | 7/1987 | Guba et al. | 400/144.2 X |
| 4,681,469 | 7/1987 | Guba | 400/144.2 X |
| 4,737,043 | 4/1988 | Guba et al. | 101/93.48 |

FOREIGN PATENT DOCUMENTS

| | | | |
|---|---|---|---|
| 3322791 | 1/1985 | Fed. Rep. of Germany | 400/144.2 |
| 176189 | 10/1982 | Japan | 400/144.2 |
| 149387 | 7/1986 | Japan | 400/59 |

*Primary Examiner*—Edgar S. Burr
*Assistant Examiner*—James R. McDaniel
*Attorney, Agent, or Firm*—Serge Abend

[57] ABSTRACT

An impact mechanism for use in an impact printer, to deliver a printing force to drive a character element against a platen by means of a print tip movable toward and away from the platen. A rockable bail bar having an axis of rotation substantially parallel to the axis of the platen is constrained to limited angular movement toward and away from the platen by a prime mover connected to the bail bar. A push rod interconnects the print tip and the bail bar for delivering impact forces to the platen as the bail bar is moved toward the platen. The push rod is normally coupled to the bail bar for delivering impact forces to the platen and may be decoupled from the bail bar for drawing the pring tip away from the platen so as to allow the character element to be removed. A decoupling mechanism is provided to lift the push rod off of the bail bar and to recouple it to the bail bar as required.

2 Claims, 4 Drawing Sheets

IMPACT MECHANISM FOR IMPACT PRINTER

FIELD OF THE INVENTION

This invention relates to an impact mechanism for an improved serial impact printer and, more particularly, to the push rod portion thereof which may be decoupled from its driver for allowing access to a print wheel. The novel impact printer in which the present mechanism is employed is designed to substantially reduce impact noise generation during the printing operation.

BACKGROUND OF THE INVENTION

The office has, for many years, been a stressful environment due, in part, to the large number of objectionable noise generators, such as typewriters, high speed impact printers, paper shredders, and other office machinery. Where several such devices are placed together in a single room, the cumulative noise pollution may even be hazardous to the health and well being of its occupants. The situation is well recognized and has been addressed by governmental bodies who have set standards for maximum acceptable noise levels in office environments. Attempts have been made by the technical community to reduce the noise pollution. Some of these methods include enclosing impact printers in sound attenuating covers, designing impact printers in which the impact noise is reduced, and designing quieter printers based on non-impact technologies such as ink jet and thermal transfer.

Noise measurements are often referenced as dBA values. The "A" scale, by which the sound values have been identified, represents humanly perceived levels of loudness as opposed to absolute values of sound intensity. When considering sound energy represented in dB (or dBA) units, it should be borne in mind that the scale is logarithmic and that a 10 dB difference means a factor of 10, a 20 dB difference means a factor of 100, 30 dB a factor of 1000, and so on.

Typically, impact printers generate impact noise in the range of 65 to just over 80 dBA, which is deemed to be intrusive. When reduced to the high 50s dBA, the noise is construed to be objectionable or annoying. It would be highly desirable to reduce the impact noise to a dBA value in the vicinity of 50 dBA. For example, the IBM Selectric ball unit typewriters generate about 68 dBA. The typewriter of the present invention has been typically measured at slightly less than 52 dBA. This represents a dramatic improvement on the order of about 100 times less noisy than present day offices, a notable achievement toward a less stressful office environment.

Although the printing impact, produced as the hammer impacts and drives the type character pad against the ribbon, the print sheet and the platen with sufficient force to release the ink from the ribbon, is the major source of noise in the typewriter, other noise sources are present. In the presently available typewriters, the impact noise overshadows the other noises. But, once the impact noise has been substantially reduced, the other noises will no longer be extraneous. Thus, the design of a truly quiet printer requires the designer to address reducing all other noise sources, such as those arising from carriage motion, character selection, ribbon lift and advance, as well as from miscellaneous clutches, solenoids, motors and switches.

In conventional ballistic hammer impact printers a hammer mass of about 2.5 grams is driven ballistically by a solenoid-actuated clapper toward the ribbon/-paper/platen combination. When the hammer hits the rear surface of the character pad it drives it against the ribbon/paper platen combination and deforms the platen which, when it has absorbed the hammer impact energy, seeks to return to its normal shape by driving the hammer back to its home position where it must be stopped, usually by another impact. This series of impacts is the main source of the objectionable noise. Looking solely at the platen deformation impact portion of the hammer movement, the total dwell time is typically in the vicinity of 100 microseconds. At a printing speed of 30 characters per second, the mean time available between character impacts is about 30 milliseconds. The impact noise reduction achieved by the printing mechanism of the present typewriter is made possible by significantly stretching the impact dwell time to a substantially larger fraction of the printing cycle than is typical in conventional printers. For instance, if the dwell time were stretched from 100 microseconds to 6 to 10 milliseconds, this would represent a sixty- to one hundred-fold increase, or stretch, in pulse width relative to the conventional. By extending the deforming of the platen over a longer period of time, an attendant reduction in noise output can be achieved.

The general concept implemented in the present typewriter, i.e. reduction in impulse noise achieved by stretching the deformation pulse, has been recognized for many decades. As long ago as 1918, in U.S. Pat. No. 1,261,751 (Anderson) it was recognized that quieter operation of the printing function in a typewriter may be achieved by increasing the "time actually used in making the impression". A type bar typewriter operating upon the principles described in this patent was commercially available at that time.

RELATED PATENTS AND APPLICATIONS

The quiet impact printing mechanism incorporating the present invention is described, and its theory of operation is explained in the following commonly assigned patents any one of whose disclosure are herein fully incorporated by reference. U.S. Pat. No. 4,668,112 (Gabor et al), entitled "Quiet Impact Printer", relates to the manner in which the impact force in a printer of this type is controlled; U.S. Pat. No. 4,673,305 (Crystal), entitled "Printwheel For Use in a Serial Printer", relates to a printwheel modified for quiet operation when used with an alignment member; U.S. Pat. No. 4,678,355 (Gabor et al) entitled "Print Tip Contact Sensor for Quiet Compact Printer", relates to an impacting element having a sensor thereon for signaling initiation of impact; U.S. Pat. No. 4,681,469 (Gabor), entitled "Quiet Impact Printer", relates to the high mass, prolonged contact period parameters of a printer of this type; U.S. Pat. No. 4,686,900 (Crystal et al), entitled "Impact Printer With Application of Oblique Print Force", relates to a shear inducing impacting element; and U.S. Pat. No. 4,737,043 (Gabor et al), entitled "Impact Mechanism for Quiet Impact Printer", relates to the unique prime mover and high mass print tip driver, including one form of the push rod which is the subject of the present invention.

The present application and two copending applications filed concurrently herewith disclose alternative push rod structures and mechanisms for opening the throat between the closely positioned elements of the traversing carriage and the platen so as to allow the operator to manipulate the printwheel in order to remove and replace it. Each copending application is entitled "Impact Mechanism for Impact Printer".

It is the primary object of this invention to provide a force transmitting member which will allow a force applying member to be maintained extremely close to the platen, in a force applying zone, during normal operation of the printer and which allows the force applying member to be retracted from the force applying zone for providing access to a character member.

It is another object of this invention to provide a force transmitting member, or push rod, for connecting a prime mover to an impacting device and a mechanism for decoupling the push rod from the prime mover so as to allow the operator to draw the impacting device away from the platen in order to permit access to the printwheel for removal and replacement.

SUMMARY OF THE INVENTION

These and other objects may be carried out, in one form, by providing an impact mechanism for use in an impact printer, to deliver a printing force to drive a character element against a platen by means of a print tip normally spaced from the surface of the platen by a throat distance and movable toward and away from the platen. The character element and the print tip are supported upon a carriage mounted upon the printer for reciprocating movement in a path substantially parallel to the axis of the platen. A rockable bail bar having having an axis of rotation substantially parallel to the axis of the platen is constrained to limited angular movement toward and away from the platen by a prime mover connected to the bail bar. A push rod interconnects the print tip and the bail bar so as to close the throat distance for delivering an impact force to the platen as the bail bar is moved toward the platen. The push rod may be decoupled from the bail bar for drawing the print tip away from the platen to a distance greater than the throat distance so as to allow the character element to be removed.

BRIEF DESCRIPTION OF THE DRAWINGS

Other objects and features and advantages of this invention will be apparent from the following, more particular description considered together with the accompanying drawings, wherein.

DETAILED DESCRIPTION OF THE ILLUSTRATED EMBODIMENT

Figure 1:
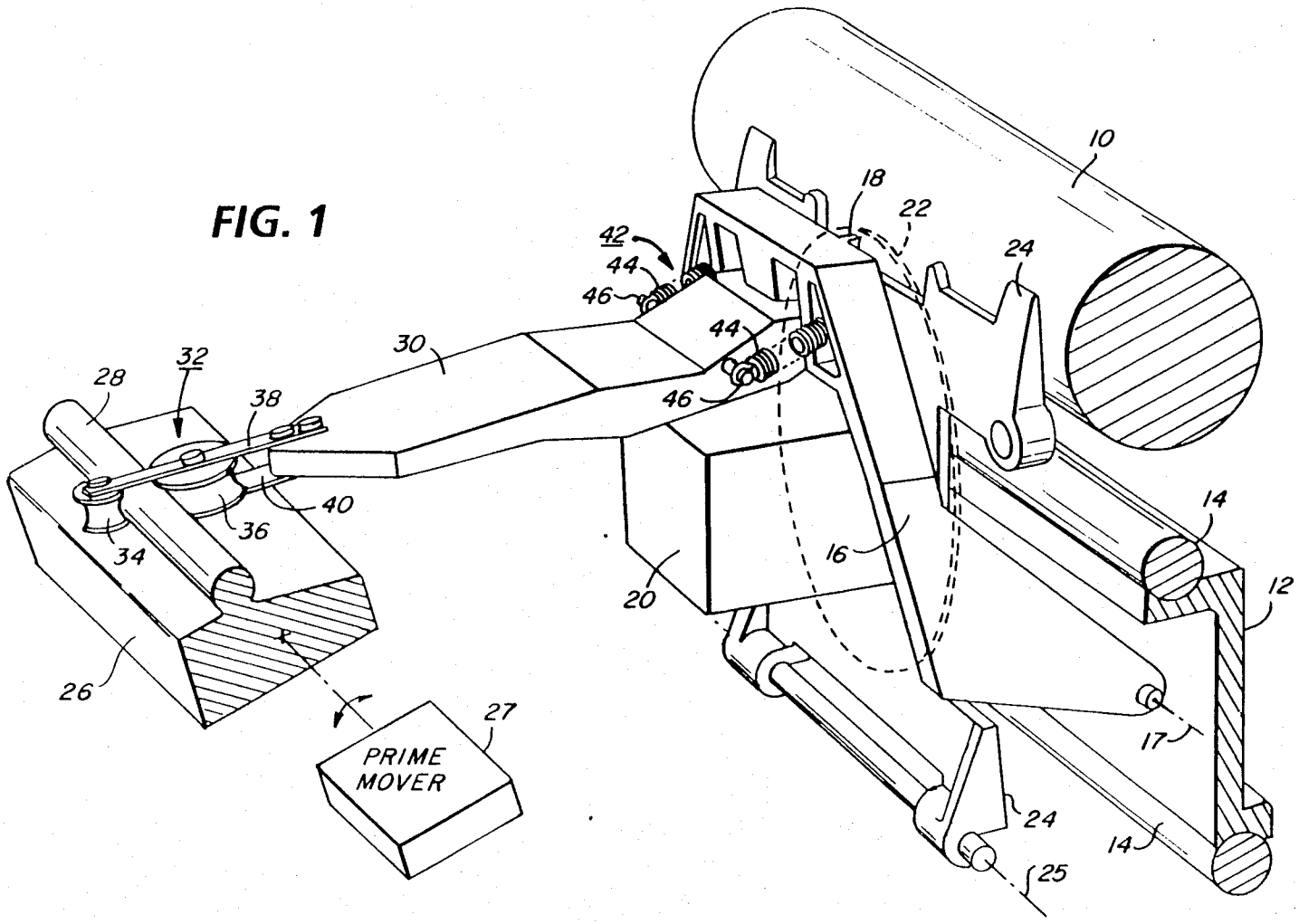
FIG. 1 is a partial perspective view showing the relevant features of a quiet impact printer in which the present invention may be incorporated.

Salient features of the quiet impact printer, in which the present invention is incorporated, are shown in FIG. 1. These include a platen 10 suitably mounted on the frame for rotation to advance and retract an image receptor on which characters may be imprinted. A carriage support beam 12 fitted with rod stock rails 14 spans the printer from side-to-side beneath and parallel to the platen for rigidly and smoothly supporting a carriage (not shown) for traversing movement parallel to the platen. A horseshoe-shaped interposer 16 is mounted upon the carriage for traversing movement therewith. It is mounted for arcuate movement about pivot axis 17 and carries print tip 18 at its apex. A printwheel motor 20 to whose shaft 21 a printwheel 22 may be secured is also mounted upon the carriage, as is a pivot frame 24 mounted for arcuate movement about pivot axis 25 for automatically controlling the throat adjustment between the print tip 18 and the platen 10 in accordance with the thickness of the image receptor, be it a single sheet of paper, card stock or a multipart form.

A rockable bail bar 26 extending and having an axis of rotation substantially parallel to axis of said platen, is constrained to limited angular movement toward and away from said platen, by a prime mover 27 connected to said bail bar for imparting this rocking movement thereto. The prime mover may be a reciprocating voice coil motor, a rotary motor or any other suitable driver. As the bail bar is rocked, a bead or rail 28 thereon moves a push rod 30 toward and away from the platen. The push rod illustrated in FIG. 1 is a generic form of this element which is rigid and non-collapsible. One end 32 of the push rod rides upon the rail 28 via a pair of capturing rollers 34 and 36 secured to the push rod by upper plate 38 and lower plate 40. The lower plate rigidly supports roller 36 while the upper plates supports both rollers. At least the outer end of the upper plate 38 may be made sufficiently flexible so as to enable the roller 34 to be snapped upon the rail 28 into seating engagement. A bead 41 on the opposite end 42 of the push rod is biased into engagement with a seat on the rear wall of the print tip 18 by means of tension springs 44 extending between pins 46 on the push rod and suitable anchors on the interposer 16. Thus, the drive force of the prime mover 27 is multiplied by the bail bar 26 and is translated to the print tip 18 by the push rod which may pivot about bead 41 so as to enable it to follow the arcuate path described by the interposer 16.

Figure 2:
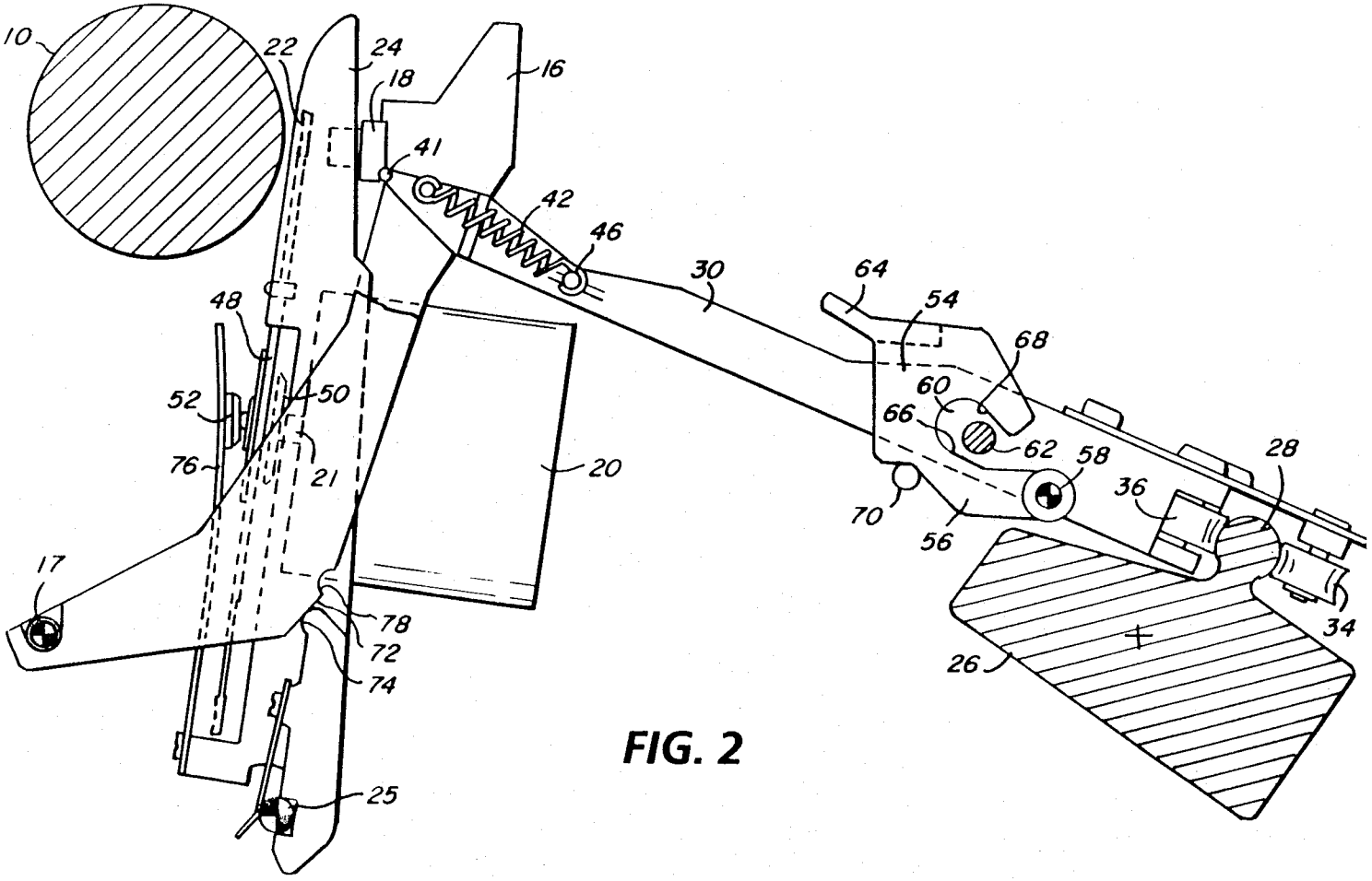
FIG. 2 is a side elevation view showing the push rod in its normal operating position.
Figure 3:
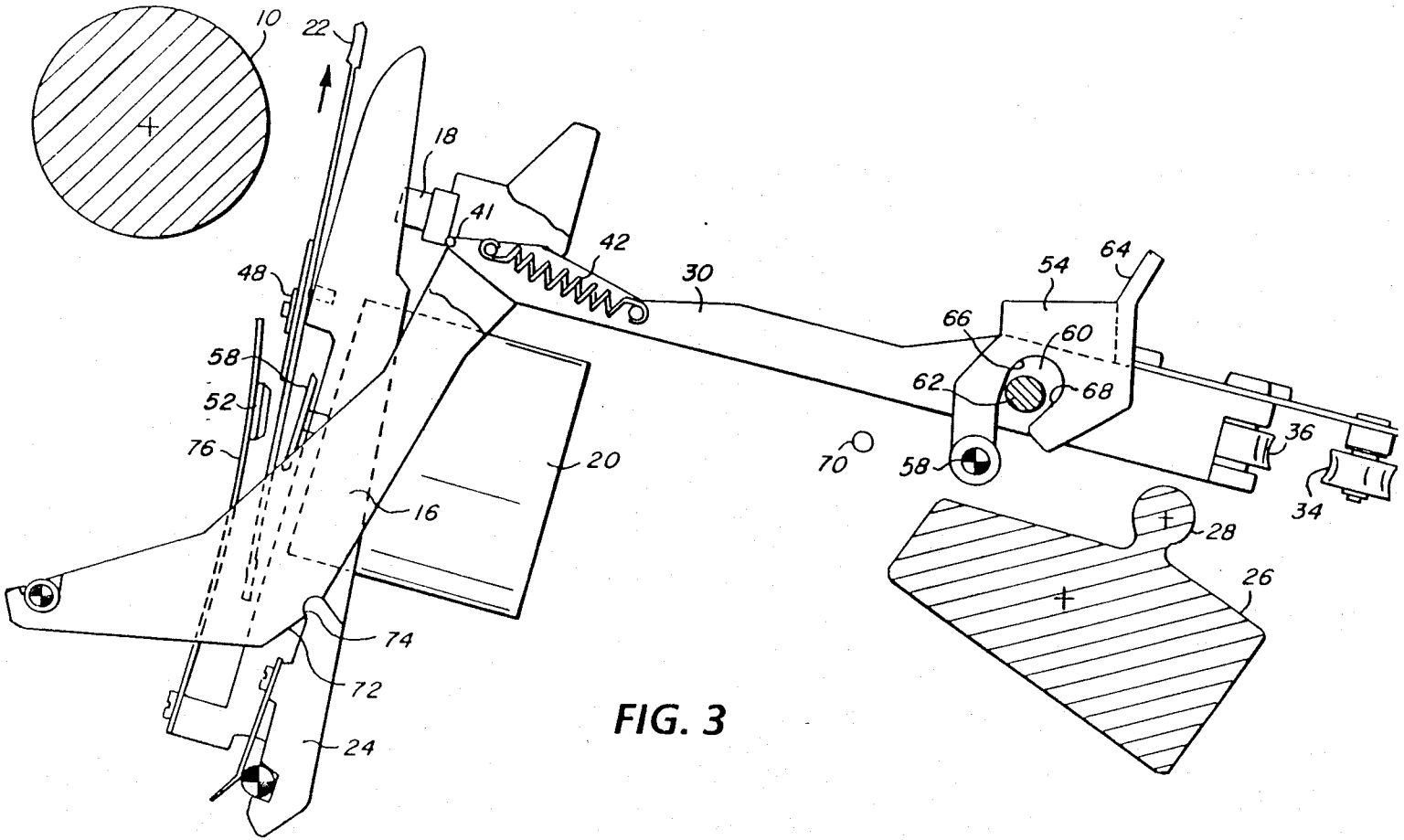
FIG. 3 is a side elevation view similar to FIG. 2 showing the decoupling member fully retracting the push rod.
Figure 4:
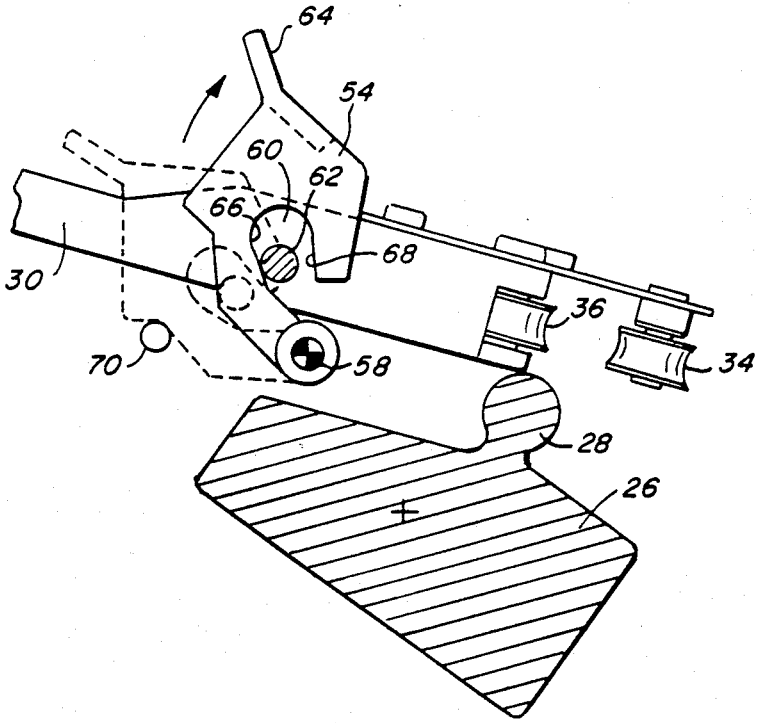
FIG. 4 is a partial side elevation view showing the action of the decoupling member.

Turning now to FIGS. 2 to 4 there is shown the push rod 30 of the present invention which may be decoupled from its driver by the operator for opening the throat between the print tip 18 and the platen 10 so as to allow access to the printwheel 22. It will be noted that as the throat is opened the pivot frame 24 is also drawn back away from the platen and the printwheel hub 48 is released from capture between drive ring 50 and retainer button 52. The force receiving end 32 of the push rod carries capturing rollers 34 and 36 in a somewhat different structure for roller 36 is strengthened as necessitated by the requirements for decoupling which will become apparent.

A decoupling lever 54 straddles the push rod with a pair of lever arms 56 which are pivotally mounted on stub shafts 58 secured upon the carriage (not shown). Each lever arm has a U-shaped camming recess 60 capturing a cam follower pin 62 protruding from the side wall of the push rod. A handle 64 allows the operator to manipulate the lever for decoupling the push rod from and recoupling it to the bail bar 26 by means of cam surfaces 66 and 68. In its neutral position, shown in FIG. 2, the lever arms 56 are supported by stop member 70 on the carriage. This member positions the decoupling lever 54 so as to allow the cam follower pin 62 to move freely within the camming recess 60, without contacting the lever arms 56, as the bail bar is rocked to reciprocate the push rod for delivering impact forces to the platen 10 via the print tip 18.

When the operator desires to replace one printwheel with another, the following steps are performed: First, the ribbon cartridge (not shown) which normally overlies the push rod is removed to provide access to the decoupling lever 54. Next the handle 64 is drawn upwardly, about pivot shafts 58, and toward the bail bar 26, causing cam surfaces 66 initially to be brought into contact cam with follower pins 62, and then to lift them, thereby lifting the push rod which pivots about bead 41, biased against the print tip 18. Continued lifting of the handle raises the rollers 34 and 36 off of the rail 28, and pulling the handle draws the raised push rod over the bail bar, as shown in FIG. 3. Simultaneously, the interposer 16 and print tip 18 are drawn away from the platen.

As the interposer is moved a knee 72 thereon contacts a bearing surface 74 on the pivot frame 24, drawing it also away from the platen. Spring arm 76, upon which the retainer button 52 is mounted, is normally biased toward the pivot frame and the printwheel drive ring 50. A restraining member (not shown) prevents the spring arm from following the pivot frame as the pivot frame is moved by the interposer 16, in order to open the printwheel drive connection established between the drive ring 50 and the retainer button 52. The handle is retracted until the bearing surface 74 falls into the detent recess 78 on the interposer, thereby establishing a locking relationship between these two members and holding the push rod in the retracted position as shown in FIG. 3. This allows the operator to release the handle and manipulate the printwheel. Alternatively, the locking action may not be employed and the operator may hold the handle with one hand while removing and replacing the printwheel with the other.

When the print wheel replacement has been effected, the handle 64 is pushed forward, i.e. rotated counterclockwise about pivot shafts 58. When cam surfaces 68 contact cam follower pins 62 the push rod will begin to be moved back toward the platen as soon as the detent action of the bearing surface 74 in detent recess 78 has been overcome. After initially moving the push rod toward the platen, the cam surfaces 68 start to drive the push rod downwardly until the rollers 34 and 36 are snapped back onto the rail 28. Finally, the ribbon cartidge may be replaced and the printer is once again made operational.

It should be understood that the present disclosure has been made only by way of example, and that numerous changes in details of construction and the combination and arrangement of parts may be resorted to without departing from the true spirit and scope of the invention as hereinafter claimed.

What is claimed:

1. An impact mechanism is an impact printer, for delivering a printing force to drive a character element against a platen by means of a print tip normally spaced from the surface of said platen by a throat distance and movable toward and away from said platen, said character element and said print tip being supported upon a carriage mounted upon said printer for reciprocating movement in a path substantially parallel to the axis of said platen, including a rockable bail bar having an axis of rotation substantially parallel to the axis of said platen, and constrained to limited angular movement toward and away from said platen, a prime mover connected to bail bar for imparting the rocking movement thereto, a push rod for interconnecting said print tip and said bail bar so as to close said throat distance for delivering an impact force to said platen as said bail bar is moved toward said platen, and decoupling means supported upon said carriage and associated with said push rod for decoupling it from and recoupling it to said bail bar, said decoupling means comprising a pivotable lever including a handle portion and a camming surface, and said push rod including a cam follower cooperable with said camming surface.

2. The impact mechanism as defined in claim 1 wherein said push rod includes a pair of rollers which straddle said bail bar during normal operation of said printer, said camming surface includes a first camming portion cooperable with said cam follower so as to lift said rollers off of said bail bar as said handle is pivoted in a first direction, and a second camming portion cooperable with said cam follower so as to return said rollers to straddle said bail bar as said handle is pivoted in a second direction.

* * * * *